US006101792A

United States Patent [19]

Noonan

[11] Patent Number: 6,101,792

[45] Date of Patent: Aug. 15, 2000

[54] FEED GUIDE FOR STRAPPING MACHINE

[76] Inventor: Jim Noonan, 9 Burdett Pl., Fairview, N.J. 07022

[21] Appl. No.: 09/199,212

[22] Filed: Nov. 24, 1998

[51] Int. Cl.[7] ..... B65B 13/04

[52] U.S. Cl. ..... 53/589; 53/582; 100/8; 100/25; 100/32; 242/615.1

[58] Field of Search ..... 53/582, 589, 389.2; 100/8, 25, 26, 32; 226/196.1; 242/615.1

[56] References Cited

U.S. PATENT DOCUMENTS

| | | | |
|---|---|---|---|
| 2,632,381 | 3/1953 | Buckland | 100/25 |
| 3,147,692 | 9/1964 | Berner | 100/25 |
| 3,447,447 | 6/1969 | Rutty | 100/26 |
| 5,112,004 | 5/1992 | Tipton | 242/615.1 |

*Primary Examiner*—Linda Johnson
*Attorney, Agent, or Firm*—Richard A. Joel, Esq.

[57] ABSTRACT

A feeding device for a strapping machine comprises a feed guide mounted to a frame to receive a nylon strap from a feed coil. The feed guide comprises a housing having a triangular cross-section and an apertured transition member mounted therein which receives the strap feed and directs the strap onto a flat exit portion of the frame. The exit portion includes a pivotal cam lock which engages the flat strap to prevent recoil thereof. The feed guide includes a predetermined internal taper which directs the strap onto a flat portion of the frame despite the angle of the incoming feed strap thereby eliminating problems with shredding of the strap which occur in the strapping head.

7 Claims, 3 Drawing Sheets

FIG. 1
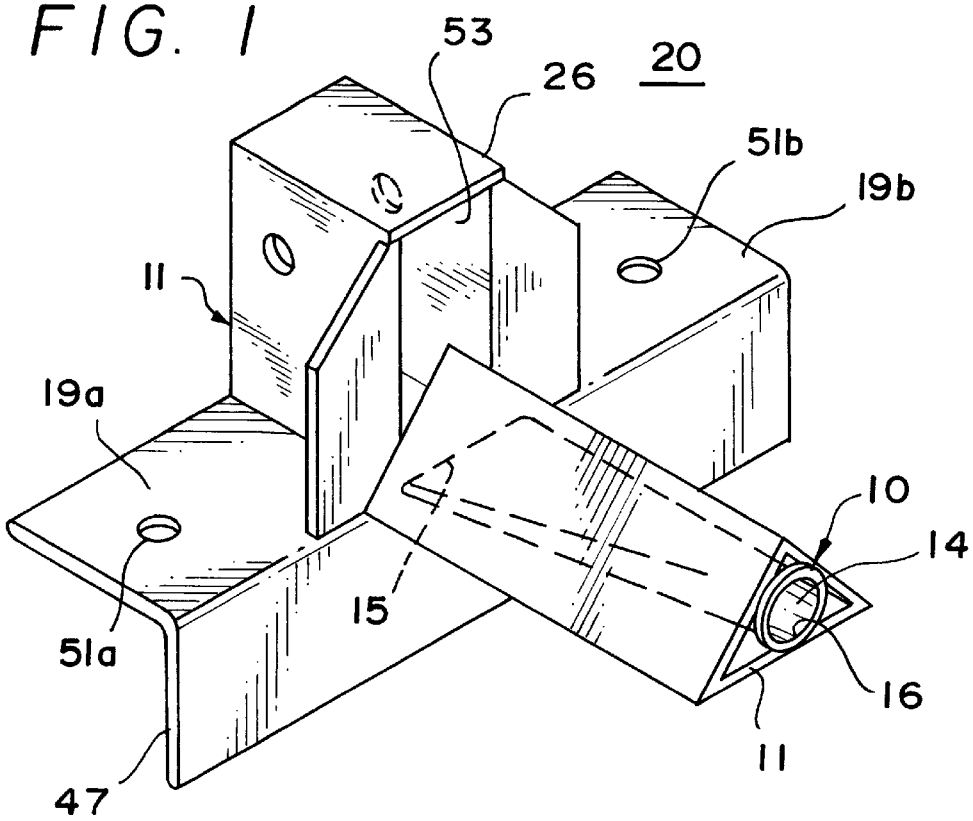
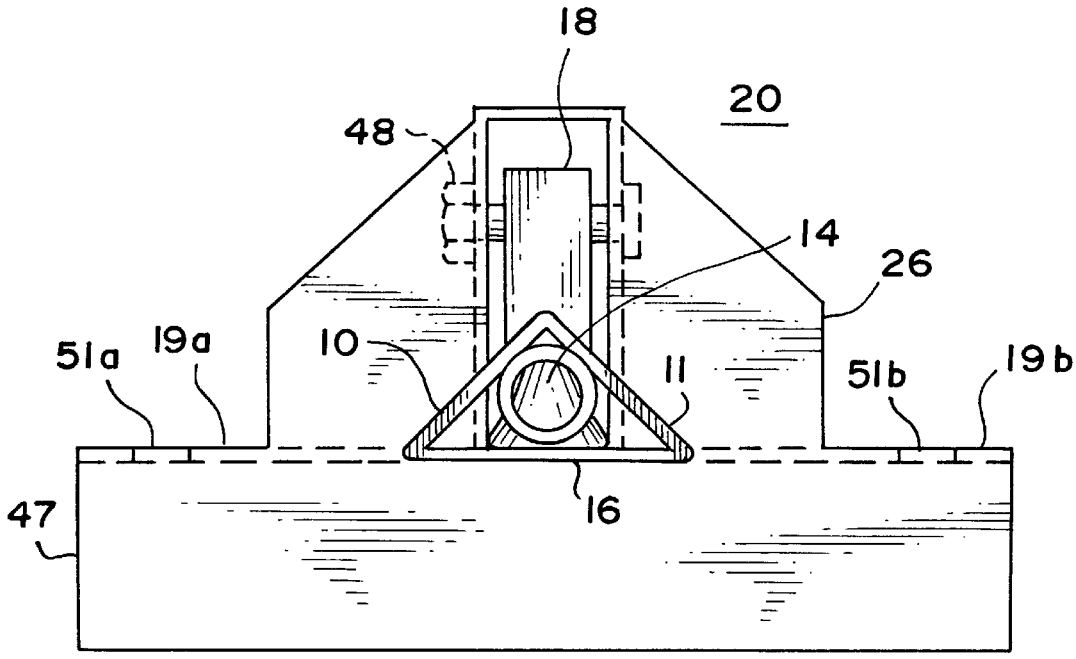
FIG. 2

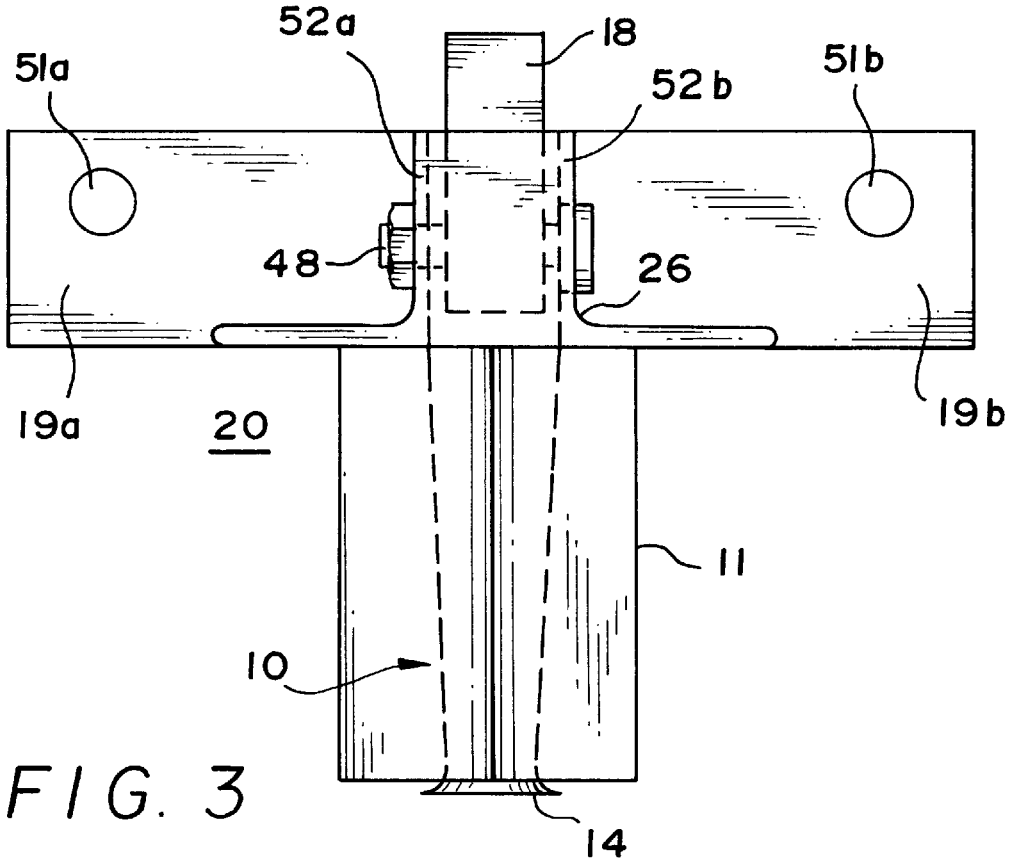
FIG. 3
FIG. 4
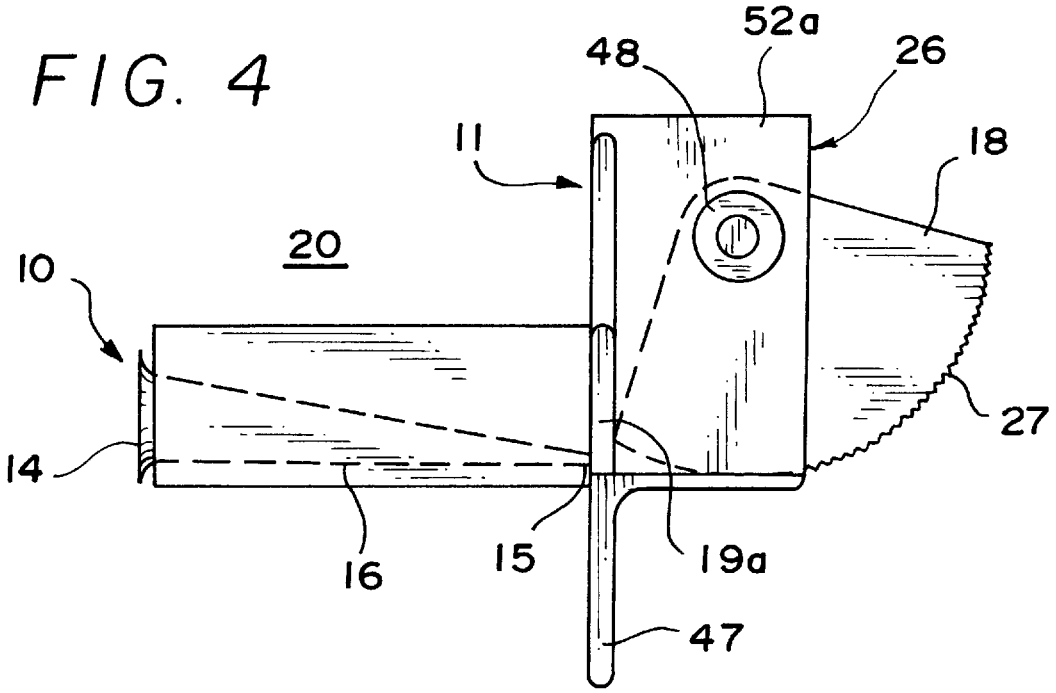

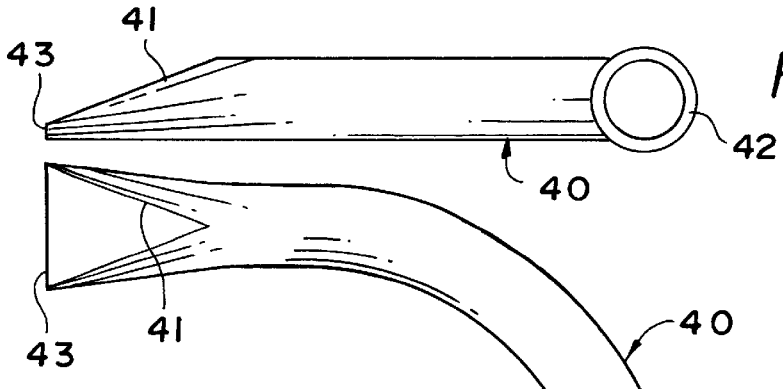
FIG. 5b
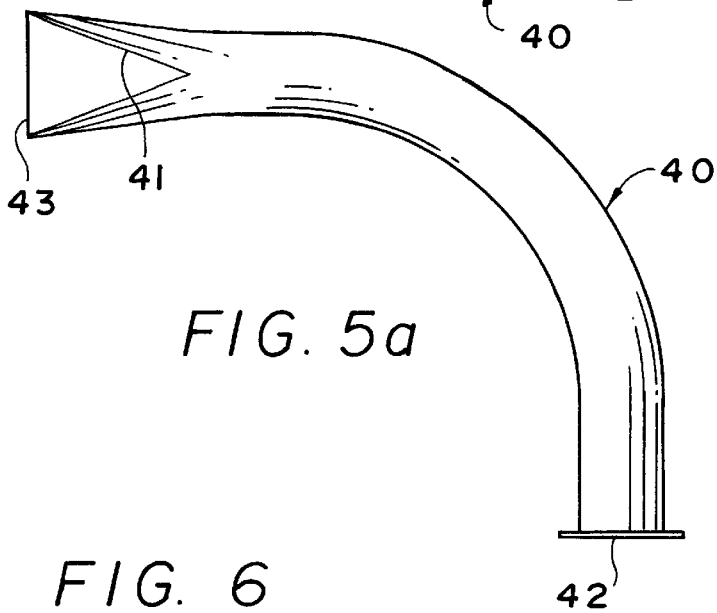
FIG. 5a
FIG. 6
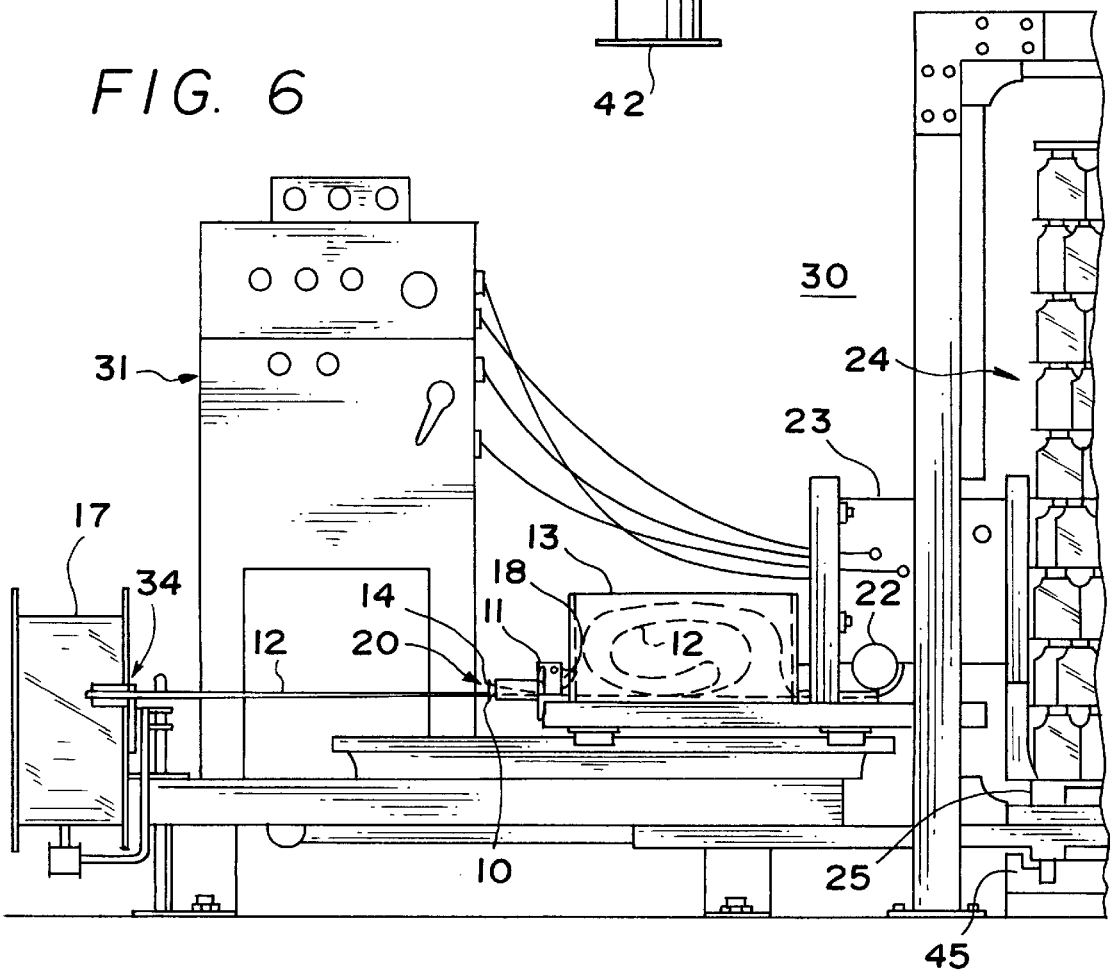

FEED GUIDE FOR STRAPPING MACHINE

BACKGROUND OF THE INVENTION

In strapping machines for automatically wrapping palletized loads with a nylon strap, a problem occurs when the coiled feed strap is fed through a guide in a non-horizontal direction. The coiled strap may be shredded or otherwise damaged as it engages a cam lock in exiting from the frame or in entering a recoil box but more especially in the wrapping head.

The prior art has failed to develop a solution although machines for strapping loads and particularly palletized loads have been around for years. Previously, an out of line strap would exit from the guide frame into a recoil container and then be fed outwardly to wrap about a palletized load. The out of line strap would be damaged in the head during the wrapping operation so that the strap might be improperly wrapped about a load or the strap shredded causing shut down of the machine and the entire production line.

To solve these problems, applicant has developed a new and improved feed guide which directs the coiled feed strap onto a flat exit frame regardless of the input feed angle. This design is new and no prior art machines have proposed a similar unique design.

SUMMARY OF THE INVENTION

This invention relates to strapping machines and particularly to a feeding device for guiding a coiled strap in a predetermined plane into a wrapping head to wrap a product which requires strapping.

In a strapping machine, a coiled strap is fed from a coil through a feed guide to a recoil container and then to a strapper head. The strap is then wrapped about the load on a pallet which moves on a conveyor. After wrapping, the strap is clipped and the excess strap recoils or moves backwardly into the recoil container. A cam lock on the feed guide device prevents the strap from moving backwards towards the coil. The strapper head pulls the strap from the coil and requires a horizontal feed.

A major problem with the strap feed was that it entered the feed guide at a vertical angle and was damaged as it entered the strapping head. Additional damage could occurred as the strap advanced through the cam lock and recoil containers towards the pallet. The present invention solves this problem by mounting a unique tapered entrance member on the machine frame which guides the strap into a horizontal feed position to be engaged periodically by the cam lock after each operation as the strap move rearwardly into a recoil container. The entrance member comprises a hollow tube having an internal taper which directs the strap into a horizontal position regardless of the angle of the strap entering the guide aperture. The strap exits the entrance member through a horizontal slot onto the frame. Thus, the strap damage which could occur if the coiled strap was fed through the cam lock to the strapping head off-line or vertical is avoided.

Accordingly, an object of this invention is to provide a new and improved feeding device for strapping machines.

Another object of this invention is to provide a new and improved feeding device which guides a coiled strap into a horizontal position for feed to a strapping machine.

A still further object of this invention is to provide a new and improved feeding device which includes a hollow internally tapered member mounted on a frame to direct a coiled strap into a horizontal position to be engaged periodically by a cam lock on said frame as it recoils from a strapping machine after a strapping operation.

A more specific object of this invention is to provide a new and improved feeding device comprising a uniquely tapered hollow tube which directs a coiled strap into a horizontal position for feeding through a recoil container to a strapping head in a machine to strap palletized loads on a conveyor.

BRIEF DESCRIPTION OF THE DRAWINGS

The above and other objects and advantages of this invention may be more clearly seen when viewed in conjunction with the accompanying drawings wherein:

FIG. 1 is a perspective view of the feeding device including the frame mounting arrangement;

FIG. 2 is a front view of the feed guide;

FIG. 3 is a top view of the feed guide;

FIG. 4 is a side view of the feed guide with portions removed to illustrate the invention;

FIG. 5*a* is a side view of a curved feed guide while FIG. 5*b* is a top view of the curved feed guide; and, FIG. 6 is a schematic view of the strapping machine incorporating the invention.

DETAILED DESCRIPTION OF THE INVENTION

Referring now to the drawings, the invention comprises a feed guide 20 for a strapping machine 30. A strapping machine 30 is used to strap any type of bulk product or more particularly palletized loads as they are fed by a conveyor 45 to the machine 30. Since such machines 30 are commercially available, they will not be described in detail herein.

The guide 20, as shown in FIG. 1, comprises a guide tube 10 mounted on a machine frame 11 to direct a strap 12 to a recoil container 13. The tube 10 is mounted on an angular support member or preferably within a elongated hollow triangular support member 11 as shown in FIGS. 2–4. The support member 11 ensures that tube 10 does not shift or distort during the strapping operations. The tube 10 includes an inlet aperture 14 and an outlet slot 15. The interior of the tube 10 is tapered along the walls 16 so that the strap 12 which is fed from the coil 17 is forced into a horizontal position at the outlet slot 15 providing a positive horizontal feed.

Previously, the strap 12 would engage the cam lock 18 at an angle at the outlet of the guide 20 possibly causing damage to the strap 12 or the strap 12 could pass vertically along the side of the cam lock 18. The system for feeding the strap 12 into the strapper head 23 did not insure that the strap remained in the flat feed position while being fed through a series of rollers 34 and wheels 22 and the recoil retaining compartment 13. The strap 12 would come off line and end up being fed into the strapping head 23 at an angle or in a vertical position which results in shredding or congealing of strap material within the head 23. This leads to shut down of the machine 30 and a back up of the production line. In operation, the strap 12 is pulled by head 23 through the guide 20 to a recoil container 21 and then outwardly over the free running wheel 22 to the strapping head 23. The strap 12 is fed about a load 24 mounted on a pallet 25, the ends sealed and the strap 12 recoiled before clipping. The clipped strap 12 retracts into the recoil container 13 while the cam lock 18 prevents the strap 12 from moving rearwardly through the guide 20 and disrupting the coil feed. Control means for the machine 30 are shown at 31.

The tube 10 may also be designed in a curved configuration 40, as shown in FIGS. 5*a*, 5*b*, with internally tapered walls 41 to direct a strap 12 from the aperture 42 to the flat outward slot 43. This permits an off-line mounting position of the coil 17 around corners or 90° bends.

The feed guide 20 essentially includes a frame 11 having flange portions 19*a* and 19*b* extending perpendicularly on each side of a raised portion 26. Fastening means (not shown) secure the flanges 19*a* and 19*b* to the machine 30 through apertures 51*a* and 51*b*. The raised portion 26 includes a downwardly extending portion 47 which engages the machine 30 below the strap feed for further support. The raised portion extends rearwardly and includes legs 52*a* and 52*b* forming a slot 53 within which the cam lock 18 is pivotally mounted by fastening means 48. The guide 20 also includes the cam lock 18 with a toothed periphery 27 pivotally mounted therein in a vertical position to engage the strap 12 and prevent rearward movement thereof. In other words, the cam lock 18 prevents the recoiling strap from exiting the recoil container 13 and fouling up the strap 12 on other parts of the machine 30. The guide 20 is fixedly mounted to the strapping machine 30.

While the invention has been explained by a detailed description of certain specific embodiments, it is understood that various modifications and substitutions can be made in any of them within the scope of the appended claims which are intended also to include equivalents of such embodiments.

What is claimed, is:

1. A feed guide for feeding a coiled strap from a coil to a strapping machine in a horizontal position comprises:

a frame for mounting on the strapping machine having an aperture extending therethrough including an inlet end and an outlet end;

a hollow triangular support member mounted at the inlet end of said frame aperture; and, a hollow guide member mounted within the support member and having a circular inlet to receive a strap feed, tapered walls directing the strap into a horizontal position within the hollow member, and an outlet slot which feeds the strap outwardly from the frame outlet end in a horizontal position.

2. A feed guide for feeding a coiled strap from a coil to a strapping machine in accordance with claim 1 further including:

a pivotal cam lock mounted to the frame at the outlet aperture and having a toothed periphery to engage the strap in a rearward direction and prevent recoil through the feed guide.

3. A feed guide for feeding a coiled strap from a coil to a strapping machine in accordance with claim 2 further including:

a recoil container mounted to the machine adjacent the cam lock to receive the strap recoil after a strapping operation.

4. A feed guide for feeding a coiled strap from a coil to a strapping machine in accordance with claim 2 further including:

flanges extending outwardly on each side of the frame, means engaging said flanges to secure said frame to the strapping machine and a vertical flange portion extending downwardly in engagement with the strapping machine to further secure said frame in position.

5. A feed guide for feeding a coiled strap from a coil to a strapping machine in accordance with claim 1 wherein:

the guide member is curved to receive a feed from a coil which is offset from the strapping machine.

6. A feed guide for feeding a coiled strap from a coil to a strapping machine in accordance with claim 1 wherein:

the strapping machine includes a strapping head for pulling said strap from the coil and wrapping said strap and a load about which said strap is wrapped.

7. A feed guide for feeding a coiled strap from a coil to a strapping machine in accordance with claim 4 wherein:

the vertical flange portion extends rearwardly and includes a central slot having side walls for pivotally mounting the cam lock between said walls.

* * * * *